US008304970B2

(12) United States Patent
VanderSluis

(10) Patent No.: US 8,304,970 B2
(45) Date of Patent: Nov. 6, 2012

(54) LIGHT UNIT WITH INDUCED CONVECTION HEAT SINK

(75) Inventor: Donald VanderSluis, Sarasota, FL (US)

(73) Assignee: Sunovia Energy Technologies, Inc., Sarasota, FL (US)

( * ) Notice: Subject to any disclaimer, the term of this patent is extended or adjusted under 35 U.S.C. 154(b) by 0 days.

(21) Appl. No.: 12/995,631

(22) PCT Filed: Jun. 2, 2009

(86) PCT No.: PCT/US2009/046023
§ 371 (c)(1),
(2), (4) Date: May 2, 2011

(87) PCT Pub. No.: WO2009/149121
PCT Pub. Date: Dec. 10, 2009

(65) Prior Publication Data

US 2011/0198977 A1 Aug. 18, 2011

Related U.S. Application Data

(60) Provisional application No. 61/058,007, filed on Jun. 2, 2008.

(51) Int. Cl.
*H01J 1/26* (2006.01)

(52) U.S. Cl. ..... 313/35; 313/36
(58) Field of Classification Search ..... 313/35
See application file for complete search history.

(56) References Cited

U.S. PATENT DOCUMENTS

| | | | | |
|---|---|---|---|---|
| 2004/0190305 | A1 | 9/2004 | Arik et al. | |
| 2005/0111234 | A1* | 5/2005 | Martin et al. | 362/555 |
| 2006/0181894 | A1 | 8/2006 | Chinniah et al. | |
| 2008/0232116 | A1* | 9/2008 | Kim | 362/365 |

FOREIGN PATENT DOCUMENTS

| | | |
|---|---|---|
| WO | 9111743 | 8/1991 |

* cited by examiner

*Primary Examiner* — Tracie Y Green
(74) *Attorney, Agent, or Firm* — Holland & Hart LLP

(57) ABSTRACT

A lighting fixture, such as a recessed or can type lighting fixture, has an external housing containing a number of LEDs used to provide light. The LEDs are connected to a power supply, and are mounted on a heat sink that includes heat-dissipating fins that are oriented vertically within a vertical portion of an internal flow tube. The internal flow tube may be U-shaped, with entry and exit points on opposite ends of the flow tube. The external housing and flow tube are oriented so as to create a path for air to rise along the heat sink as it is heated then flow back down along the unheated path of the flow tube. An air mover may also be placed in the flow tube to provide further air flow through the flow tube.

13 Claims, 7 Drawing Sheets

LIGHT UNIT WITH INDUCED CONVECTION HEAT SINK

FIELD

The present disclosure related to thermal management in lighting luminaires, and more specifically, to a light unit with a heat sink having induced convection.

BACKGROUND

Lighting systems traditionally use various different types of illumination devices, commonly including incandescent lights, fluorescent lights, and solid state lights. Solid state lights commonly include Light Emitting Diode (LED) based lights, although other types of solid state light elements may be utilized. LED based lights, also referred to as LED based luminaries, rely on multiple diode elements to produce sufficient light for the needs of the particular light or lighting system. LED-based luminaires offer significant advantages in efficiency and longevity compared to, for example, incandescent sources and produce much less waste heat. LEDs offer greater life than compact fluorescents and contain no environmentally harmful mercury as fluorescents do. LED-based luminaires also offer the advantage of instant-on and are not degraded by repeated on-off cycling.

Within the visible spectrum, LEDs can be fabricated to produce desired colors. For applications where the LED is to be used in area lighting, a white light output is typically desirable. There are two common ways of producing high intensity white-light LED. One is to first produce individual LEDs that emit three primary colors (red, green, and blue), and then mix all the colors to produce white light. Such products are commonly referred to as multi-colored white LEDs, and sometimes referred to as RGB LEDs. Such multi-colored LEDs generally require sophisticated electro-optical design to control the blend and diffusion of different colors, and this approach has rarely been used to mass produce white LEDs in the industry to date. In principle, this mechanism has a relatively high quantum efficiency in producing white light.

A second method of producing white LED output is to fabricate a LED of one color, such as a blue LED made of InGaN, and coating the LED with a phosphor coating of a different color to produce white light. One common method to produce such and LED-based lighting element is to encapsulate InGaN blue LEDs inside of a phosphor coated epoxy. A common yellow phosphor material is cerium-doped yttrium aluminum garnet (Ce3+:YAG). Depending on the color of the original LED, phosphors of different colors can also be employed. LEDs fabricated using such techniques are generally referred to as phosphor based white LEDs. Although less costly to manufacture than multi-colored LEDs, phosphor based LEDs have a lower quantum efficiency relative to multi-colored LEDs. Phosphor based LEDs also have phosphor-related degradation issues, in which the output of the LED will degrade over time. Although the phosphor based white LEDs are relatively easier to manufacture, such LEDs are affected by Stokes energy loss, a loss that occurs when shorter wavelength photons (e.g., blue photons) are converted to longer wavelength photons (e.g. white photons). As such, it is often desirable to reduce the amount of phosphor used in such applications, to thereby reduce this energy loss. As a result, LED-based white lights that employ LED elements with such reduced phosphor commonly have a blue color when viewed by an observer.

Various other types of solid state lighting elements may also be used in various lighting applications. Quantum Dots, for example, are semiconductor nanocrystals that possess unique optical properties. The emission color of quantum dots can be tuned from the visible throughout the infrared spectrum. This allows quantum dot LEDs to create almost any output color. Organic light-emitting diodes (OLEDs) include an emitting layer material that is an organic compound. To function as a semiconductor, the organic emitting material must have conjugated pi bonds. The emitting material can be a small organic molecule in a crystalline phase, or a polymer. Polymer materials can be flexible; such LEDs are known as PLEDs or FLEDs.

Many solid state lighting units, such as LED-based luminaries, do have a challenge in reducing junction temperature of the individual elements that output light. Unlike incandescent sources, where filament temperatures are intrinsically high, it is desirable for LEDs to limit their junction temperature in order to maintain relatively long lifetimes. Dissipating waste heat generated from such devices is important to increasing the life capability of LED based luminaries.

SUMMARY

The present disclosure provides several exemplary embodiments of a luminaire incorporating solid state lighting elements and thermal elements that act to remove heat generated by light elements. A housing is provided, in some embodiments, that is configured to receive solid state light sources, thermal elements, and associated power supplies and/or other optical elements. Housings provided also include a flow tube configured to move air across the thermal element. Embodiments include both luminaires originally designed to utilize solid state light elements, or in retrofit assemblies designed to convert an existing luminaire that uses a traditional light source or sources into a luminaire that uses solid state light elements.

In one embodiment, a lighting apparatus is provided that comprises (a) a housing; (b) a flow tube within the housing having an entry at a first end thereof and an exit at a second end thereof; (c) a heat dissipating element mounted within the housing and positioned to be at least partially within the flow tube in proximity to the first end; and (d) a plurality of solid state light elements mounted within the housing and coupled to the heat dissipating element. The plurality of solid state light elements generate heat that is transferred to the heat dissipating element. The heat dissipating element is configured to induce air flow through the flow tube through the heating of air within the flow tube. In an embodiment, the housing has a top and bottom surface and the first and second ends are located in the bottom surface. The lighting apparatus may also include an air mover in proximity of the second end that generates air flow from the first end to the second end. The air mover may comprise an electrostatic fan, or bladed fan. The housing, in an embodiment, is configured to be a recessed can light.

In some embodiments, the flow tube is U-shaped with air flow induced through the flow tube from the first end to the second end by convection heating of air within the flow tube by the heat dissipating element. The heat dissipating element comprises, in an embodiment, a heat sink having a plurality of fins arranged in a direction parallel to the axis of the portion of the flow tube adjacent to the heat sink. The solid state light elements may comprise LEDs, OLEDs, PLEDs, FLEDs, and quantum dots, for example. The lighting apparatus may also include at least one other non-solid-state light element, such as an incandescent or fluorescent light.

DETAILED DESCRIPTION

Figure 1:
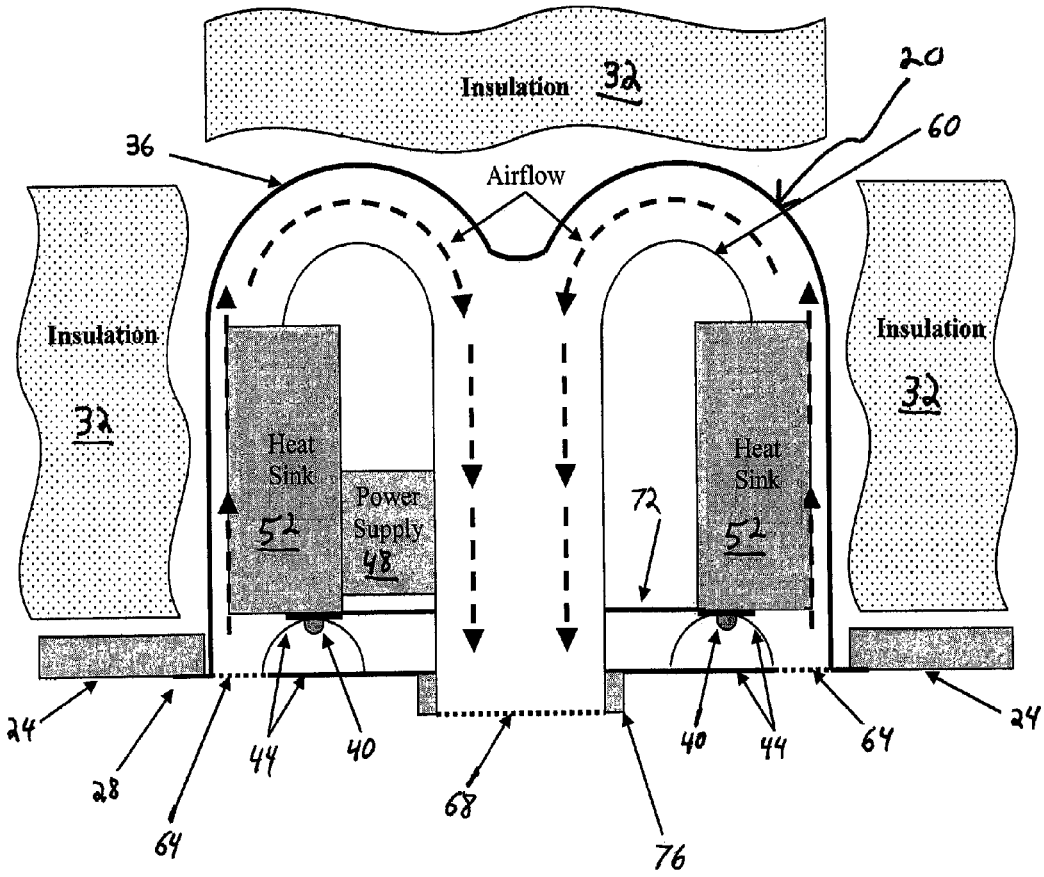
FIG. 1 is a cross sectional illustration of a lighting fixture of an exemplary embodiment.

For a more complete understanding of this invention, reference is now made to the following detailed description of several exemplary embodiments as illustrated in the drawing figures, in which like numbers represent the same or similar elements. Various exemplary embodiments are described herein, with specific examples provided in many instances to serve to illustrate and discuss various concepts included in the present disclosure. The specific embodiments and examples provided are not necessarily to be construed as preferred or advantageous over other embodiments and/or examples.

Various embodiments provide a light unit in which air (or other fluid) is induced to flow across a thermal element and dissipate heat produced by light elements within the light unit. The present disclosure recognizes that many present day designs for solid state lighting units rely on some form of exposed heat sinking whether in direct contact with the solid state lighting element, such as an LED package, or via a heat pipe. The ability of the heat sink to transfer heat to the surrounding medium, typically ambient air, relies on both the flow of that medium, such as convection and/or forced flow, and radiation.

Radiation is dependant on the emissivity of the material which varies depending on base material and surface finish. In typical terrestrial applications, radiation is only a small percentage of total heat transfer. Forced air (or other fluid) cooling can provide a steady, known volume of air flowing over a heat sink which has broad usage over many applications. However, conventional air movers, primarily rotating bladed fans, generally have a lifetime limit that is significantly lower than the typical lifetime for a solid state light element such as a typical high intensity LED. Thus, a conventional fan would likely need replacing one or more times during the lifetime of the solid state lighting device, negating many of the advantages of a low maintenance solid state luminaire.

Convection cooling is dependent upon effective heat sink surface area and possible airflow across the heat sink. In installations where airflow can be sufficiently high, more thermal energy can be removed than in static environments with no or minimal airflow. Thus applications with increased airflow across a heat sink are better able to reduce LED junction temperature for a given power. In installations where there is minimal or no ambient circulation is present, convective cooling is less effective to reduce LED junction temperature. The present invention provides embodiments with heat-driven air circulation to provide enhanced cooling in applications with no or minimal ambient circulation and without the need for moving mechanical components, although such components may be include in luminaires of various exemplary embodiments.

Figure 2:
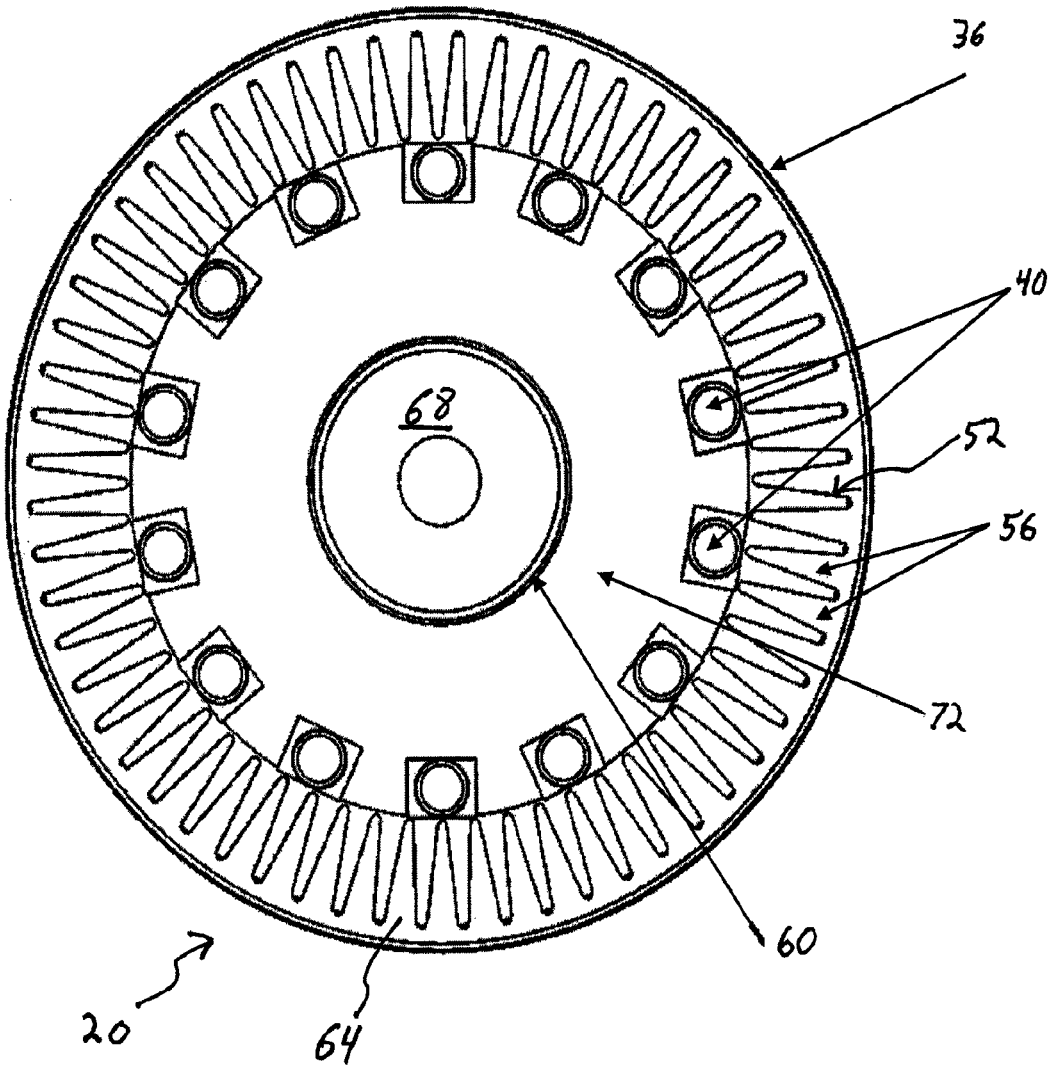
FIG. 2 is a bottom plan view of the lighting fixture of FIG. 1.

With reference now to FIGS. 1-2, an exemplary embodiment of the present disclosure is described. In this embodiment, a lighting fixture 20 is a recessed, or can, type lighting fixture that is installed, for example, in a ceiling 24 of a residence. Such installations are common, and the lighting fixture 20 is typically mounted to the ceiling 24 with a mounting rim 28. Directly above the ceiling material it is common to have insulating material 32 that is placed above the ceiling in an attic or dropped ceiling, for example. In any event, recessed lighting fixtures such as fixture 20 are commonly installed in applications where insulating material surrounds the fixture or is adjacent to at least a portion of the external housing of the fixture. The external housing 36 of the lighting fixture 20, in this embodiment, contains a number of LEDs 40 used to provide light. The fixture 20 may include any number of LEDs 40 as may be required for a particular application. Furthermore, other non-LED type lighting elements may be present in the fixture. The LEDs 40 may be coupled with optical elements 44 that provide reflection, refraction, or diffusion as may be desired for a particular application. The LEDs 40 are connected to a power supply 48, and are mounted on a heat sink 52. The heat sink 52 includes heat-dissipating fins 56 that are oriented vertically. The heat sink 52 is mounted in an internal flow tube 60, which in this embodiment is U-shaped, with an entry 64 and exit 68 points on opposite ends of the flow tube. The external housing 36 and flow tube 60 are oriented so as to create a path for air to rise along the heat sink 52 as it is heated then flow back down along the unheated path of the flow tube 60, as illustrated by the arrows in FIG. 1. The LEDs 40, in this embodiment, are mounted to a printed circuit board 72. A grill or other grating may optionally be included at the entry 64 and exit 68. The exit 68 in the embodiment of FIGS. 1 and 2 includes a retainer 76 to which a grating may be mounted. In the exemplary embodiment of FIGS. 1 and 2, the assembly 20 is circular in form, as viewed from the bottom. As discussed, recessed or can lighting units are commonly installed having insulating material adjacent to at least a portion of the external housing, thereby creating an environment that is thermally restricted. Providing an airflow path in such an environment allows for enhanced convective cooling, and thereby allows LEDs, and/or other optical elements, to operate at a reduced temperature in order to provide an enhanced light lifetime.

Figure 3:
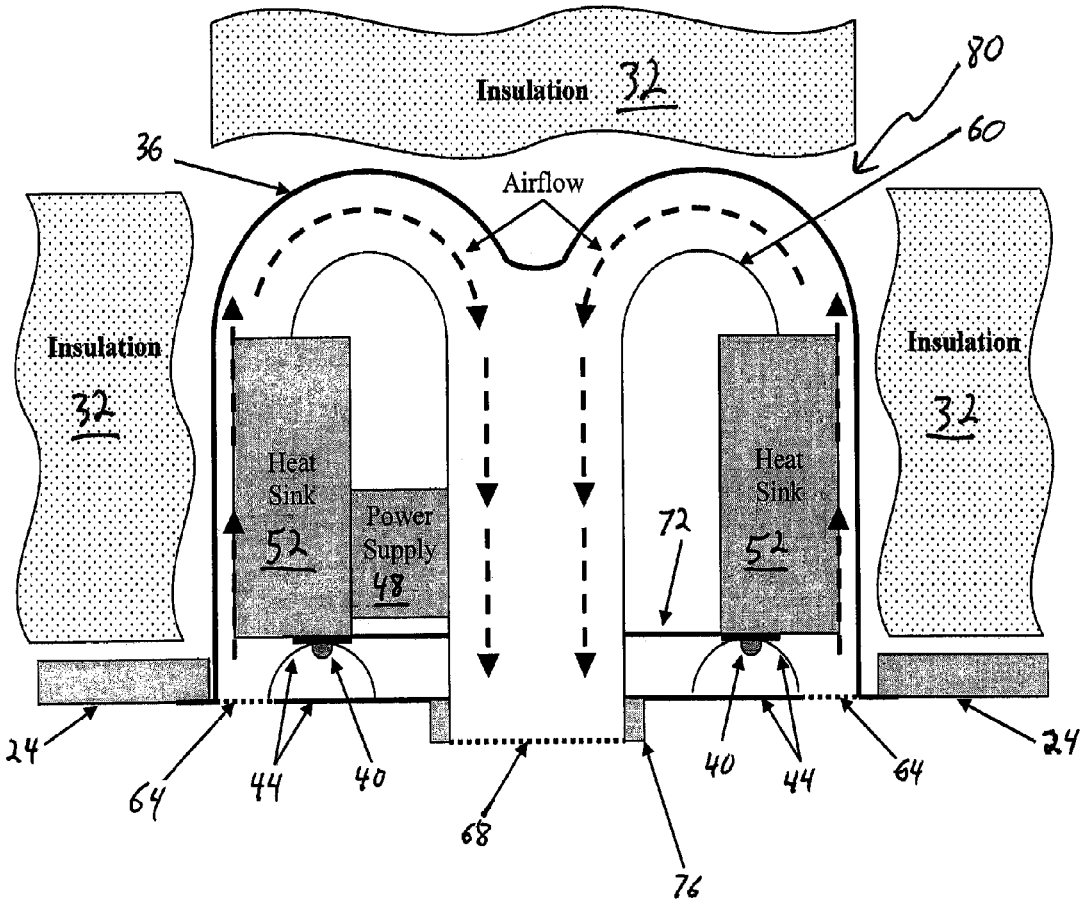
FIG. 3 is a cross sectional illustration of a lighting fixture of another exemplary embodiment.
Figure 4:
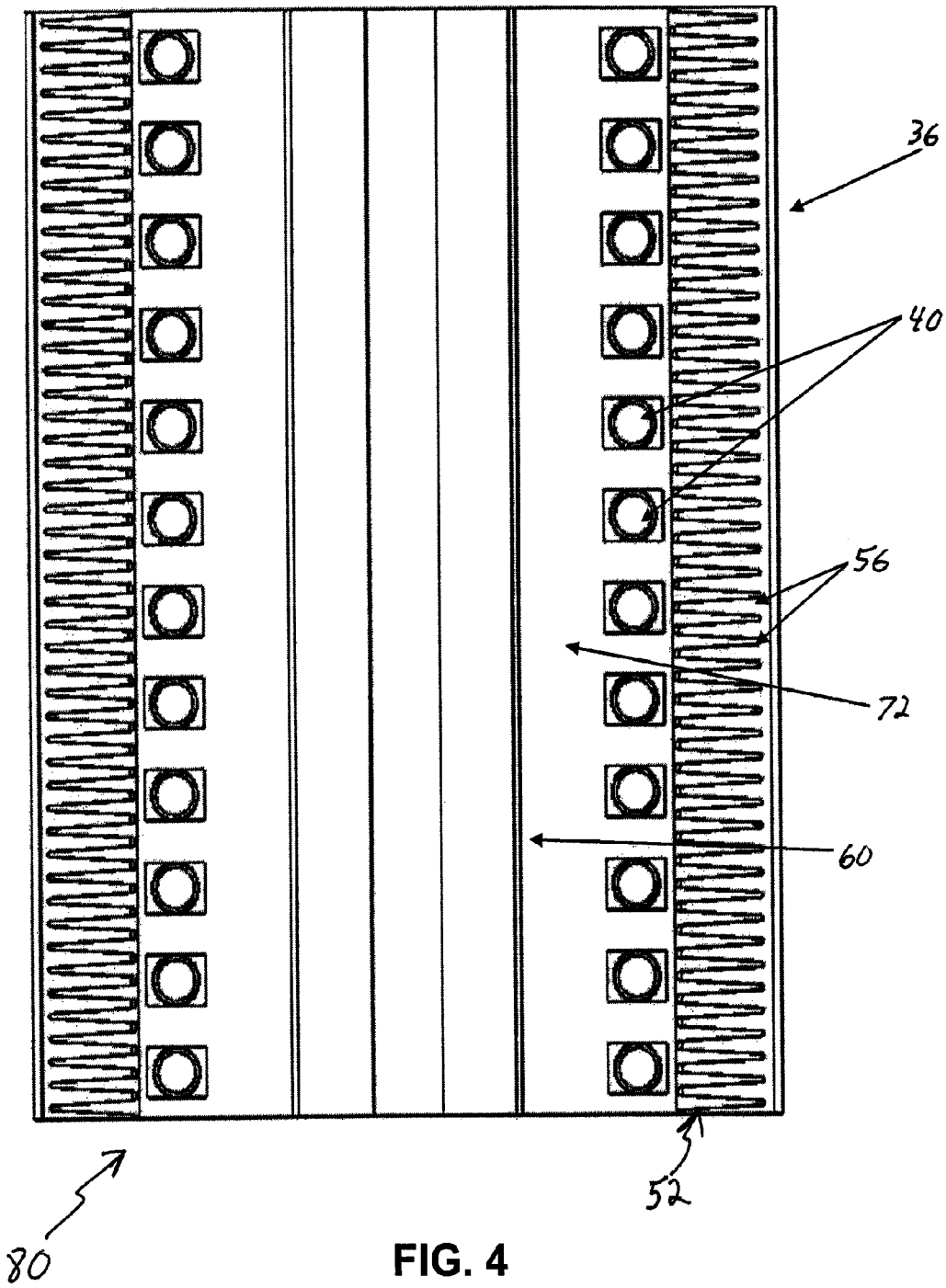
FIG. 4 is a bottom plan view of the lighting fixture of FIG. 3.
Figure 5:
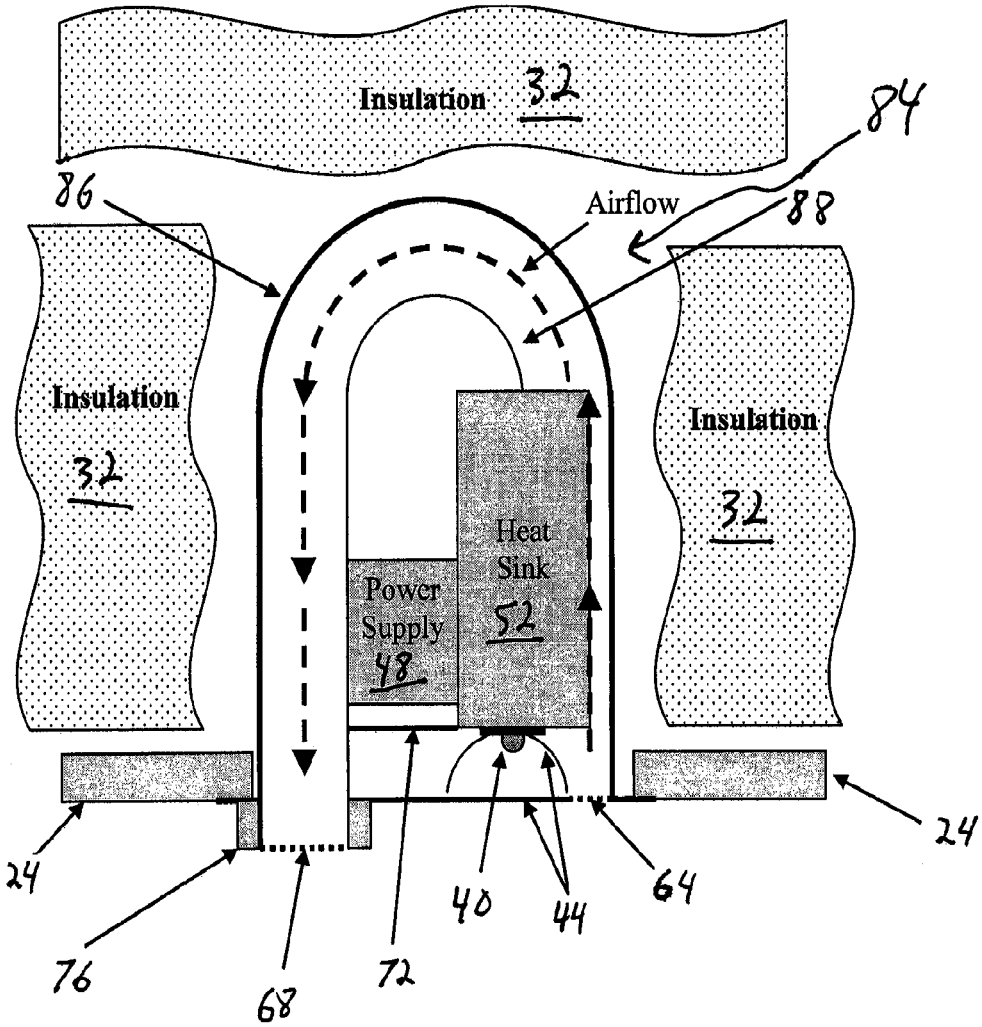
FIG. 5 is a cross sectional illustration of a lighting fixture of another exemplary embodiment.
Figure 6:
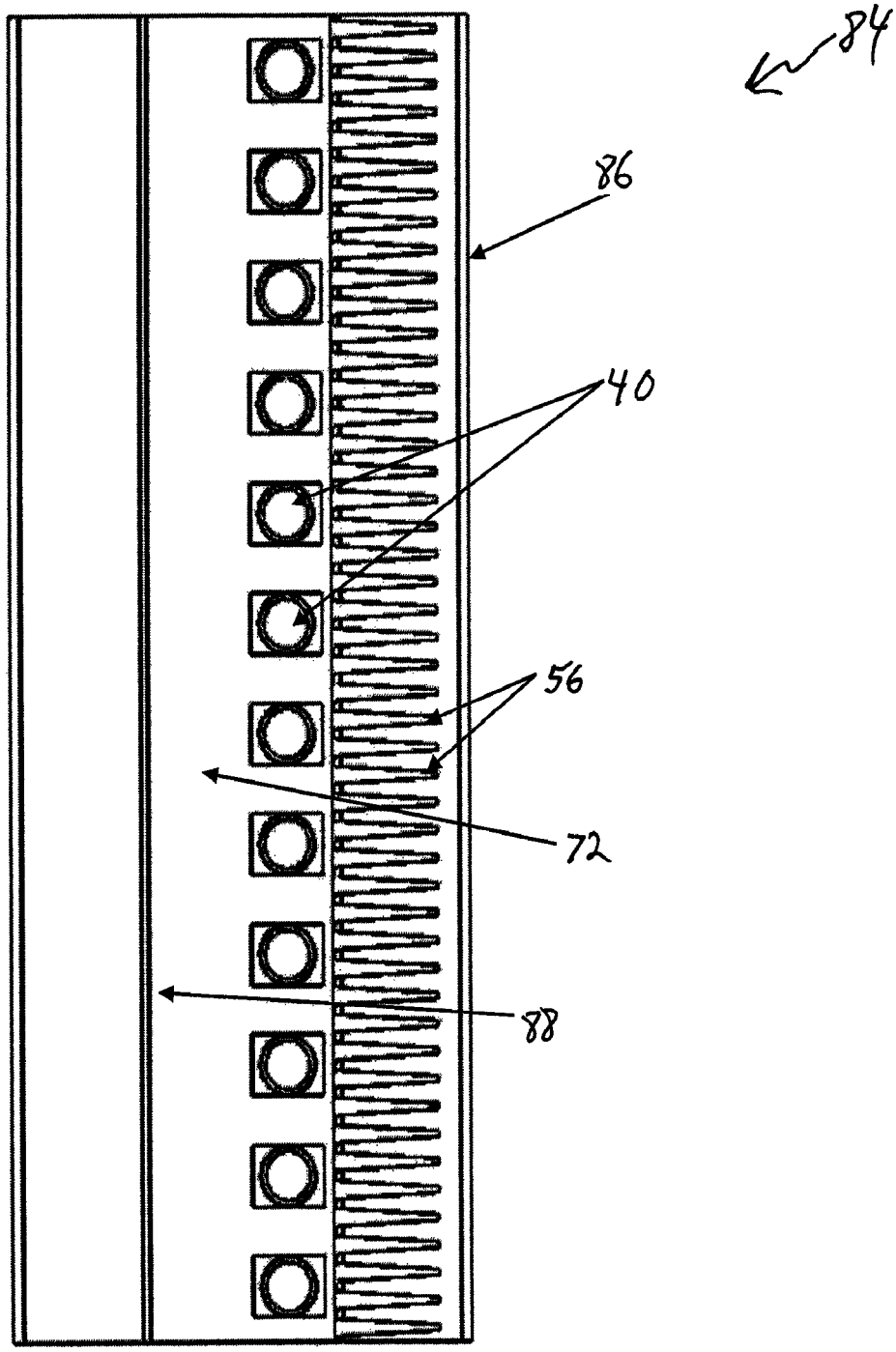
FIG. 6 is a bottom plan view of the lighting fixture of FIG. 5.

In some embodiments, the external housing 36 may also include additional insulation to help isolate heat generated by the light fixture 20 from adjacent space that may be at a different temperature than the space illuminated by the luminaire. This may provide an additional energy savings by reducing heating/cooling losses FIGS. 3-4 illustrate an alternative embodiment that includes flow tube 60 having a similar cross-section with U-shaped flow path, but a rectangular shaped lighting fixture 80 with multiple rows of lighting elements 40, rather than circular configuration as illustrated in FIGS. 1-2. FIGS. 5-6 illustrate another exemplary embodiment with a lighting fixture 84 having a rectangular housing configuration 86 and a single row of LED elements 40, with an associated U-shaped flow path 88.

Figure 7:
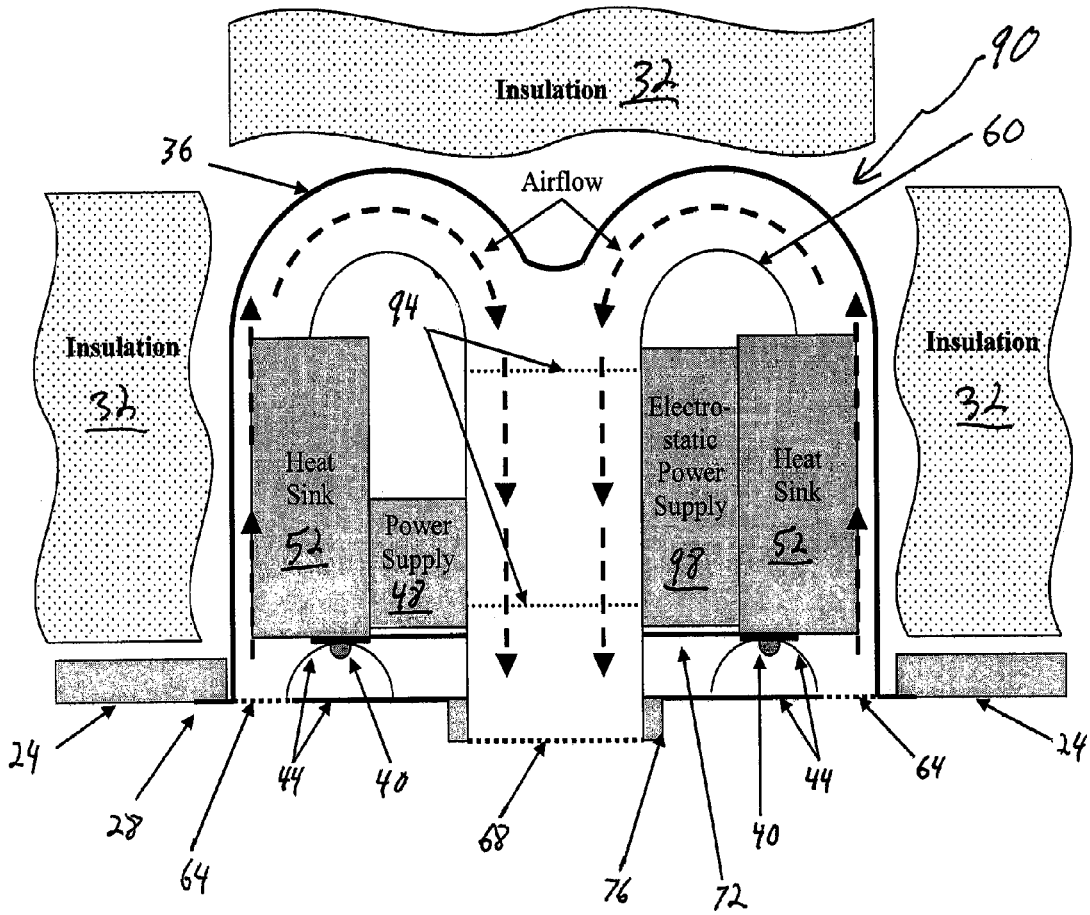
FIG. 7 is a cross sectional illustration of a lighting fixture of another exemplary embodiment.

FIG. 7 illustrates yet another exemplary embodiment in which a light fixture 90 includes an air mover in the flow tube 60. Such an embodiment may be useful, for example, in applications where it is desirable to utilize LEDs of a greater power, where convection cooling would be insufficient, and/or in an environment with relatively high temperatures or low air density. In such situations, convection cooling may not be sufficient to reduce LED junction temperature enough to have a meaningful impact of the lifetime of the LED. The embodiment of FIG. 7 provides, in addition to the convective air flow path, a non-moving air mover. In this embodiment, the air mover includes electrostatic fans that are utilized to enhance air flow across the heat sink. Electrostatic fans have had increasing usage in silent air movers and in air filtration products whose basic function is well established. The use of such air moving technology to cooling LEDs in this exemplary embodiment provides enhanced cooling while also avoiding moving parts, such as a rotating fan and thereby maintains reliability for a longer period than a conventional fan.

In the exemplary embodiment of FIG. 7, the top center of the housing 36 contains one or more electrodes 94 differing polarities that, when powered by power supply 98, provide air flow. The electrodes 94 are positioned sufficient distance down the inner flow tube 60 to provide the required air flow while maintaining appropriate electrical safety.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A lighting apparatus, comprising:

a housing defining a top plane and a bottom plane;

a flow tube within said housing having an entry at a first end thereof and an exit at a second end thereof;

a heat dissipating element mounted within said housing and positioned to be at least partially within said flow tube in proximity to said first end and located proximate to said bottom plane;

a plurality of solid state light elements mounted within said housing and coupled to said heat dissipating element, said solid state light elements configured to emit light through said bottom plane, said plurality of solid state light elements generating heat that is transferred to said heat dissipating element, said heat dissipating element configured to induce air flow through said flow tube, from said first end to said second end, through the heating of air within said flow tube.

2. The lighting apparatus of claim 1, wherein said first and second ends are located in said bottom plane.

3. The lighting apparatus of claim 1, further comprising:

an air mover in proximity of said second end that generates air flow from said first end to said second end.

4. The lighting apparatus of claim 3, wherein said air mover comprises an electrostatic fan.

5. The lighting apparatus of claim 1, wherein said housing is configured to be a recessed can light.

6. The lighting apparatus of claim 1, wherein said flow tube is U-shaped with air flow induced through the flow tube from said first end to said second end by convection heating of air within said flow tube by said heat dissipating element.

7. The lighting apparatus of claim 1, wherein said heat dissipating element comprises a heat sink having a plurality of fins arranged in a direction parallel to the axis of the portion of said flow tube adjacent to said heat sink.

8. The lighting apparatus of claim 1, wherein said solid state light elements comprise light emitting diodes (LEDs).

9. The lighting apparatus of claim 1, further comprising at least one other non-solid state light element.

10. The lighting apparatus of claim 9, wherein said non-solid-state light elements comprises an incandescent light.

11. A lighting apparatus, comprising:

a recessed can housing defining a top plane and a bottom plane;

a flow tube within said housing having an entry at a first end thereof and an exit at a second end thereof;

a heat dissipating element mounted within said housing and positioned to be at least partially within said flow tube in proximity to said first end;

a plurality of solid state light elements mounted within said housing and coupled to said heat dissipating element, said solid state light elements configured to emit light through said bottom plane, each of said solid state light elements comprising:

a light source, and an optical element that is located physically separately from said flow tube;

said plurality of solid state light elements generating heat that is transferred to said heat dissipating element, said heat dissipating element configured to induce air flow through said flow tube, from said first end to said second end, through the heating of air within said flow tube.

12. The lighting apparatus of claim 11, wherein said flow tube is U-shaped with air flow induced through the flow tube from said first end to said second end by convection heating of air within said flow tube by said heat dissipating element located proximate said bottom plane.

13. The lighting apparatus of claim 11, wherein said heat dissipating element comprises a heat sink having a plurality of fms arranged in a direction parallel to the axis of the portion of said flow tube adjacent to said heat sink.

* * * * *